US005683154A

United States Patent [19]

Chang

[11] Patent Number: 5,683,154

[45] Date of Patent: Nov. 4, 1997

[54] DESK

[76] Inventor: Chien-Kuo Chang, Fl. 10-2, No. 447, Sec. 3, Wen-Hsin Road, Taichung City, Taiwan

[21] Appl. No.: 786,778

[22] Filed: Jan. 21, 1997

[51] Int. Cl.[6] ..... A47B 17/03

[52] U.S. Cl. ..... 312/194; 312/317.3; 312/314; 312/322; 108/94

[58] Field of Search ..... 108/50, 64, 94, 108/152; 312/194, 197, 21, 23, 25, 28, 310, 311, 314, 317.3, 322, 204, 317.1, 249.9, 249.1

[56] References Cited

U.S. PATENT DOCUMENTS

| | | | |
|---|---|---|---|
| 1,985,189 | 12/1934 | Moore | 312/322 |
| 2,293,496 | 8/1942 | Egger | 312/322 X |
| 2,580,032 | 12/1951 | Lindelof | 312/322 X |
| 2,587,469 | 2/1952 | Herring | 312/314 X |
| 2,590,959 | 4/1952 | Granditer | 312/317.1 X |
| 2,605,153 | 7/1952 | Lietz | 312/322 X |
| 2,928,703 | 3/1960 | Paulsen | 312/194 X |
| 2,988,413 | 6/1961 | Bergen | 108/94 X |
| 3,072,453 | 1/1963 | Evans et al. | 312/317.3 |
| 4,258,963 | 3/1981 | Fusselman et al. | 312/194 |
| 4,830,614 | 5/1989 | Schricker et al. | 108/94 X |
| 5,020,867 | 6/1991 | McManus | 312/317.3 X |
| 5,401,095 | 3/1995 | Williams et al. | 312/314 X |
| 5,454,636 | 10/1995 | Taub | 108/94 X |

FOREIGN PATENT DOCUMENTS

| | | | |
|---|---|---|---|
| 1029304 | 6/1953 | France | 312/322 |
| 5068609 | 3/1993 | Japan | 312/317.3 |
| 509262 | 7/1939 | United Kingdom | 312/317.3 |
| 876413 | 8/1961 | United Kingdom | 312/317.3 |

OTHER PUBLICATIONS

Sweets Catalog File, 1942, "Glide–Away Table Base Cabinet".

*Primary Examiner*—Peter M. Cuomo
*Assistant Examiner*—James O. Hansen
*Attorney, Agent, or Firm*—Charles E. Baxley, Esq.

[57] ABSTRACT

A desk includes a top which has four legs extending from a bottom thereof. A frame is disposed to the bottom of the top and which has two tracks formed on two opposite sides thereof for a sliding plate to be slidably received therein which has an L-shaped plate disposed thereto. An auxiliary rack has one end thereof pivotally connected to the L-shaped plate and the other end of the auxiliary rack has wheels disposed thereto so as to roll on the ground. The auxiliary rack includes two horizontal first side rails and two vertical second side rails and a board disposed between the two first side rails. The auxiliary rack has a section where the board does not extend and two rods are connected between the two first side rails within the section so as to hang suspension files between the two rods. A rectangular support is pivotally disposed to the bottom of the top for a key board to be put thereon.

5 Claims, 3 Drawing Sheets

DESK

BACKGROUND OF THE INVENTION

1. Field of the Invention

The present invention relates to desk and, more particularly, to an improved desk used in an office and which has an auxiliary rack and a support respectively pivotally connected to the desk.

2. Brief Description of the Prior Art

A desk used in an office generally includes a top from which four legs extend from a bottom of the desk and at least one drawer is retractably disposed to the desk. File racks, file boxes, desk trays and a computer set are put on the top. However, the top has only a limited area so that most of desks in an office having busy actions are in a mess by piles of documents on the desk.

The present invention intends to provide an improved desk having an auxiliary rack and a support respectively pivotally disposed thereto such that files can be received in the auxiliary rack and key board of a computer is put on the support such that the above-mentioned problems can be mitigated and/or obviated.

SUMMARY OF THE INVENTION

The present invention provides a desk which includes a top and four legs extend from a bottom of the top. A frame has two tracks formed on two opposite sides thereof and is fixedly disposed to the bottom of the top.

A sliding plate is slidably received in the two tracks and has an L-shaped plate extending from an end thereof.

An auxiliary rack has a horizontal portion and a vertical portion which extends downwardly from one of two ends of the horizontal portion. The horizontal portion includes two first side rails with a board disposed between the two first side rails and a receiving member is disposed to an under side of the board of the other end of the horizontal portion such that the L-shaped plate is pivotally engaged with the receiving member by a pin. The vertical portion includes two second side rails and has two wheels respectively disposed to a free end of each of the two second side rails. The horizontal portion has a section where the board does not extend and two rods are connected between the two first side rails within the section.

It is an object of the present invention to provide a desk having an auxiliary rack disposed to a bottom of a top of the desk so as to receive files in the auxiliary rack.

It is another object of the present invention to provide a desk having a support pivotally disposed to the bottom of the top so as to put a key board on the support.

It is a further object of the present invention to provide a desk wherein the auxiliary rack and the support are received to the bottom of the top.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
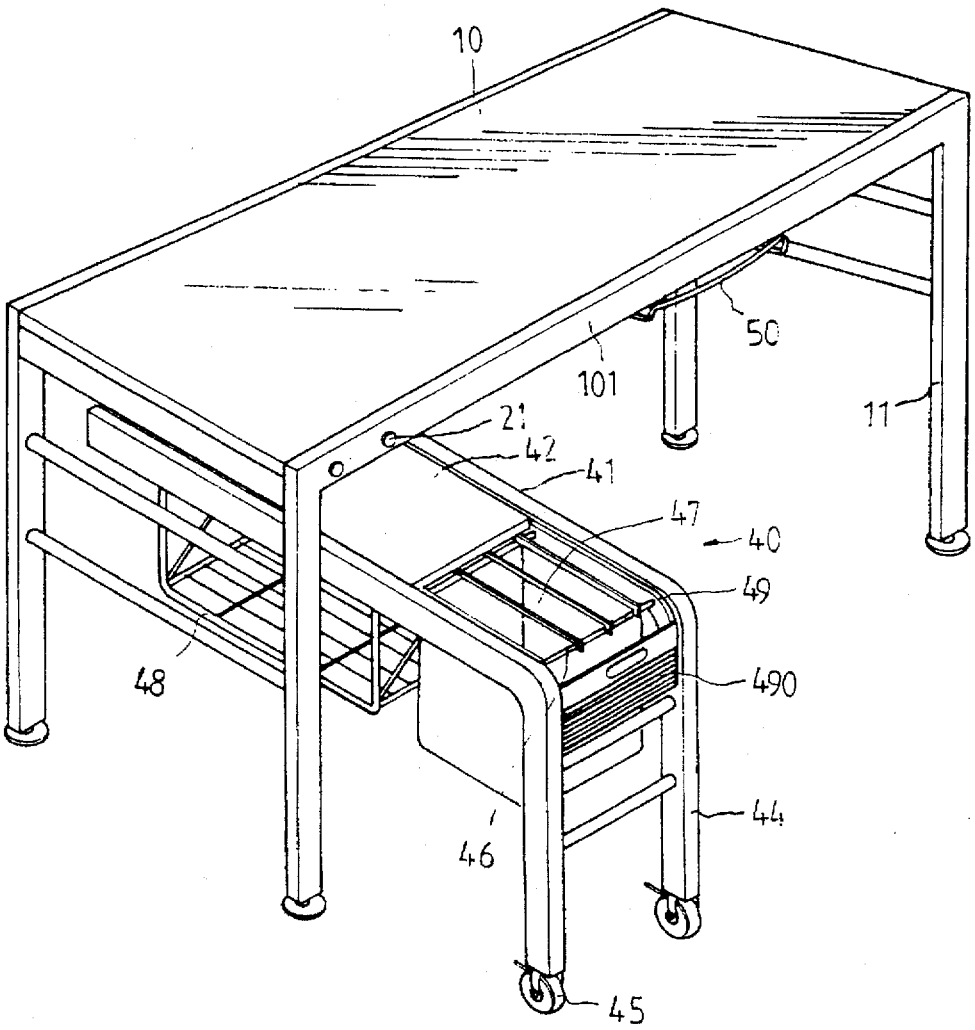
FIG. 1 is a perspective view of a desk in accordance with the present invention.
Figure 2:
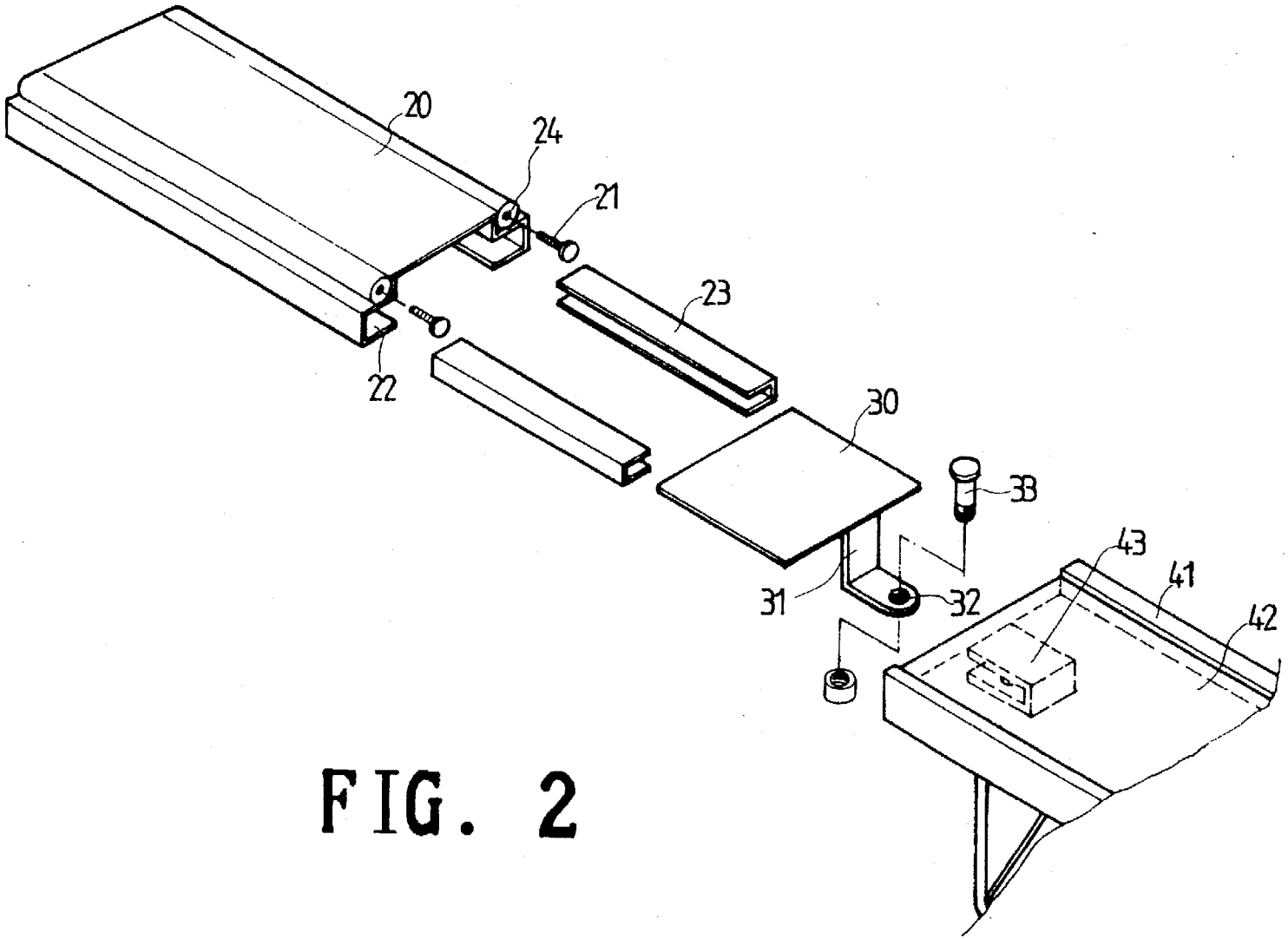
FIG. 2 is an exploded view of a frame, a sliding plate and an end of the auxiliary rack in accordance with the present invention.
Figure 3:
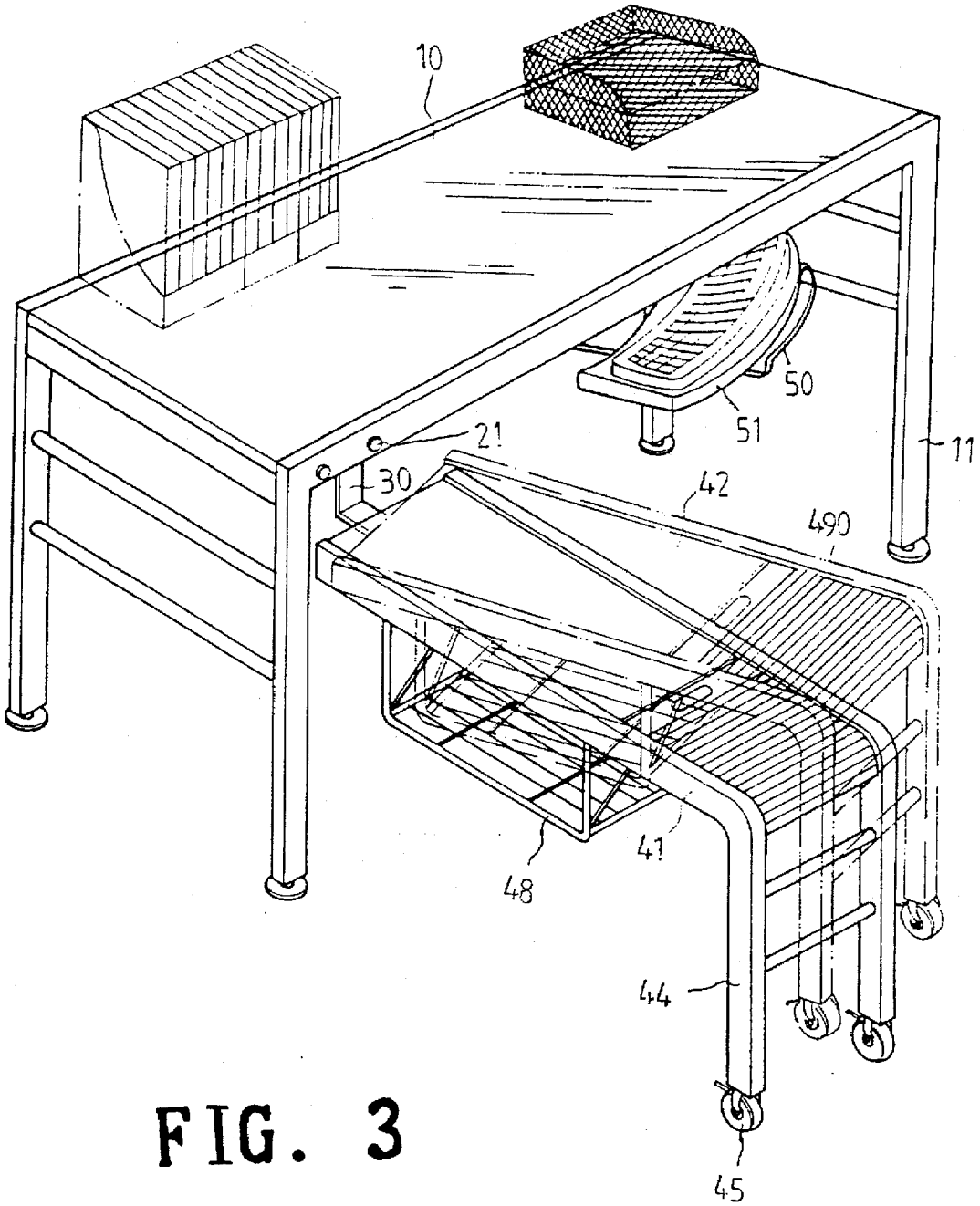
FIG. 3 is a perspective view to show the auxiliary rack and the support are pulled out from the desk.

Referring to FIGS. 1 through 3, a desk in accordance with the present invention generally includes a top 10 and four legs 11 extend from a bottom of the top 10 wherein the top 10 has four side plates 101 extending downwardly from a periphery thereof. A frame 20 has two tracks 22 formed on two opposite sides thereof and two tubular members 24 are disposed above the two tracks 22 such that the frame 20 is fixedly disposed to the bottom of the top 10 by extending bolts 21 through the side plate 101 of the top 10 and threadedly engaging the bolts 21 into the tubular members 24. Each of the side tracks 22 has an acrylic bush 23 securely received therein so as to effectively reduce friction thereof.

A sliding plate 30 is received in the two tracks 22 and is slidably moved along the acrylic bushes 23. The sliding plate 30 has an L-shaped plate 31 extending from an end thereof and the L-shaped plate 31 has a hole 32 defined therethrough.

An auxiliary rack 40 has a horizontal portion and a vertical portion which extends downwardly from one of two ends of the horizontal portion. The horizontal portion includes two first side rails 41 and a board 42 is disposed between the two first side rails 41. A receiving member 43 is disposed to an under side of the board 42 of the other end of the horizontal portion such that the L-shaped plate 31 is pivotally engaged with the receiving member 43 by a pin 33 extending through the receiving member 43 and extending through the hole 32 of the L-shaped plate 31. The vertical portion includes two second side rails 44 and has two wheels 45 respectively disposed to a free end of each of the two second side rails 44 such that the auxiliary rack 40 can be retracted along the two tracks 22 and pivoted about an axis of the pin 33. The horizontal portion has a section where the board 42 does not extend and two rods 46 are connected between the two first side rails 41 within the section such that suspension files 47 are hung across the two rods 46. The auxiliary rack 40 has a bracket 48 disposed to the under side of the board 42 so as to receive documents in the bracket 48. Each of the first side rails-41 and the second side rails 44 has a groove 49 defined in an inner side thereof so as to slidably receive a cover 490 therein between the two first side rails 41 and the second side rails 44 such that the cover 490 can be pulled to cover the section as shown in FIG. 3.

A support 50 being a rectangular member is pivotally disposed to the bottom of the top 10 such that the support 50 can be received beneath the top 10 and can be pivoted out to put a key board 51 on the support 50.

Accordingly, the desk has the auxiliary rack 40 and the support 50 respectively to be received beneath the top 10 so that files and key board 51 can be arranged to be received beneath the top 10 and the top 10 has more area can be used.

Although the invention has been explained in relation to its preferred embodiment, it is to be understood that many other possible modifications and variations can be made without departing from the spirit and scope of the invention as hereinafter claimed.

What is claimed is:

1. A desk comprising:

a top and four legs extending from a bottom of said top;

a frame having two tracks formed on two opposite sides thereof and said frame being fixedly disposed to said bottom of said top;

a sliding plate slidably received in said two tracks and having an L-shaped plate extending from an end thereof, said L-shaped plate having a hole defined therethrough;.

an auxiliary rack having a horizontal portion and a vertical portion which extends downwardly from one of two ends of said horizontal portion, said horizontal portion including two first side rails with a board disposed between said two first side rails, a receiving member disposed to an under side of said board of the other end of said horizontal portion such that said L-shaped plate is pivotally engaged with said receiving member by a pin, said vertical portion including two second side rails and having two wheels respectively disposed to a free end of each of said two second side rails, said horizontal portion having a section where said board does not extend and two rods connected between said two first side rails within said section.

2. The desk as claimed in claim 1 wherein said auxiliary rack has a bracket disposed to said under side of said board.

3. The desk as claimed in claim 1 wherein each of said first side rails and said second side rails has a groove defined in an inner side thereof so as to slidably dispose a cover therein between said two first side rails and said second side rails.

4. The desk as claimed in claim 1 wherein a support is pivotally disposed to said bottom of said top.

5. The desk as claimed in claim 4 wherein said support is a rectangular frame.

* * * * *